US006313830B1

(12) United States Patent
Yusa

(10) Patent No.: US 6,313,830 B1
(45) **Date of Patent: *Nov. 6, 2001**

(54) LIQUID CRYSTAL DISPLAY

(75) Inventor: Kazuyuki Yusa, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/135,056

(22) Filed: Aug. 18, 1998

(30) Foreign Application Priority Data

Aug. 21, 1997 (JP) ..... 9-224860

(51) Int. Cl.[7] ..... G09G 5/00

(52) U.S. Cl. ..... 345/204; 345/87; 345/95; 345/98; 345/100; 345/101; 345/212; 327/530; 350/332

(58) Field of Search ..... 345/87, 98, 100, 345/101, 204, 212, 95; 327/530; 350/332

(56) References Cited

U.S. PATENT DOCUMENTS

| | | | | |
|---|---|---|---|---|
| 4,781,437 | * | 11/1988 | Shields et al. | 345/87 |
| 5,510,748 | * | 4/1996 | Erhart et al. | 327/530 |
| 5,635,950 | * | 6/1997 | Okada et al. | 345/95 |
| 5,739,816 | * | 4/1998 | Kobayashi et al. | 345/204 |
| 5,798,747 | * | 8/1998 | Moraveji | 345/98 |
| 5,999,158 | * | 12/1999 | Sekido et al. | 345/98 |
| 6,014,122 | * | 1/2000 | Hashimoto | 345/98 |

FOREIGN PATENT DOCUMENTS

| | | |
|---|---|---|
| 59-99203 | 7/1984 | (JP) . |
| 63-74035 | 4/1988 | (JP) . |
| 4-252312 | 9/1992 | (JP) . |
| 5-114291 | 5/1993 | (JP) . |
| 7-334124 | 12/1995 | (JP) . |
| 8-56128 | 2/1996 | (JP) . |
| 8-171081 | 7/1996 | (JP) . |
| 8-185144 | 7/1996 | (JP) . |
| 8-211853 | 8/1996 | (JP) . |
| 8-251016 | 9/1996 | (JP) . |

OTHER PUBLICATIONS

Japanese Office Action dated Sep. 28, 1999, with partial translation.
Japanese Office Action dated Sep. 28, 1999.
Korean Office Action dated Jan. 27, 2001.

* cited by examiner

*Primary Examiner*—Bipin Shalwala
*Assistant Examiner*—Vincent G. Kovalick

(57) ABSTRACT

A liquid crystal display makes it possible to reduce the current consumption and to prevent abnormal writing to a liquid crystal. A liquid crystal display driver of the liquid crystal display comprises: a shift register inputting a clock signal CLK; a data register inputting display data DR, DG and DB and outputs control signals DRc, DGc and DBc; and a latch, a DAC and an output amplifier inputting strobe signals respectively. This output amplifier makes output power only for amended source lines higher, based on the output power control signals DRc, DGc and DBc indicating whether the source line is being amended or not.

18 Claims, 7 Drawing Sheets

LIQUID CRYSTAL DISPLAY

BACKGROUND OF THE INVENTION

The present invention relates to a liquid crystal display which is especially driven by a liquid crystal display driver.

DESCRIPTION OF THE RELATED ART

In the conventional display device, a liquid crystal display is used to make the display device smaller. For this liquid crystal display, a liquid crystal display (hereinafter referred to as LCD) panel of active matrix system using thin film transistor (hereinafter referred to as TFT) that functions as a switch for each pixel is frequently used.

In order to drive this TFT-LCD panel, an LCD driver has been used. This conventional LCD driver is explained in FIGS. 1, 2 and 3. FIG. 1 shows a block diagram of a conventional LCD driver.

The LCD driver in FIG. 1 comprises a shift register 501 into which the clock signal CLK is inputted, a data register 503 into which red data DR, green data DG and blue data DB, as display data of red, green and blue are inputted, a latch 505 into which a strobe signal STB is inputted, a DAC 507 into which a strobe signal is inputted and an output amplifier 509 into which a strobe signal is inputted. And the output amplifier 509 comprises plural output amplifiers having respective output terminals.

The shift register 501 into which a clock signal CLK is inputted outputs the data into the data register 503.

The data register 503 into which display data DR, DG and DB are inputted outputs the data into the latch 505 based on the output data from the shift register 501.

The latch 505 into which a strobe signal STB and data from the data register 503 are inputted latches the data and also outputs the latched data to the DAC 507.

The DAC 507 which a strobe signal STB is inputted into and which received the data from the latch 505 converts the data from digital to analog and outputs an analog signal to the output amplifier 509.

The output amplifier 509 into which a strobe signal STB is inputted outputs the output signal from each output terminal based on the outputted data from the DAC 507.

FIG. 2 shows a timing chart of the signals in the LCD driver, shown in FIG. 1. These are a clock signal 601, several data which are synchronized with this clock signal 601 such as red data 603, green data 605, blue data 607, a strobe signal 609 and an analog output 611.

FIG. 3 shows a block diagram of the conventional output amplifier shown in FIG. 2. As shown in FIG. 3, this output amplifier comprises a constant current circuit 701 whose one terminal is grounded and the other is connected to a differential input circuit 703, a differential input circuit 703 having a voltage by a power supply 705 supplied, inputting an analog input and a current outputted from a constant current circuit 701, and outputting an output signal to a gate of a transistor 711, a power supply 705 supplying voltage to all the output amplifier, a bias current circuit 707 inputting the analog input and outputting a bias current to a constant current circuit 709, a constant current circuit 709 inputting a voltage from the power supply 705 and a bias current from the bias current circuit 707, and outputting an output signal to a terminal of a transistor 711, a transistor 711 whose one terminal is connected to the constant current circuit 709, the other terminal is grounded and a gate is connected to the differential input circuit 703, and an output terminal 713 which connects between the constant current circuit 709 and the transistor 711.

The drive of the TFT-LCD panel is implemented by said LCD panel.

As mentioned above, the TFT-LCD panel is driven by the LCD driver, however the drive is transmitted to the TFT-LCD panel through a source line.

On the other hand, the TFT-LCD panel has some problem of line defect in the production process. Therefore, to increase the yield ratio, by setting wiring around the surroundings part of the LCD panel beforehand, the line defect is amended.

FIG. 4 shows an example of the TFT-LCD panel with line defects. In FIG. 4 the conceptual diagram is indicated to show the process of amendment of the line defects in both the present invention and the conventional LCD.

As shown in FIG. 4 , plural source lines are wired at the LCD panel 401. The source lines which have line defects 403 are indicated as to be amended source lines 405. These source lines are connected to the output terminal of the LCD driver.

At the amended source lines 405, surrounded wiring 407 has been disposed.

As indicated in FIG. 4, at the line defect of the LCD, the yield ratio of the LCD has been increased by utilizing the surrounded wiring 407.

In the source lines of the LCD, as shown in FIG. 4, two kinds of source lines exist, one being amended source lines and the other being non-amended source lines.

The electric characteristics of the amended source line and non-amended source line are not the same. In particular, the wiring resistance and capacitance of the amended source line are larger than those of the non-amended source line, and the output amplifier for that line needs higher output power.

Therefore, in the conventional device, to drive the amended source line, the output capacity of the LCD driver is designed to meet the load of the amended source line (heavy load). Thus, to drive the amended source line, the output power for the line defect needs to be higher. Therefore a size of a transistor within the output amplifier is changed so that the output power of the whole amplifier is increased.

However, in the LCD diver of the above mentioned conventional LCD, the current consumption of the output amplifier is determined by the inside bias current, and both the amended source line (heavy load) and non-amended source line (light load) are driven by high power output amplifier. Therefore, the inside bias current which needs only to drive the heavy load in the amended source line is applied for the whole output amplifier applying all source lines, and for the non-amended light load source line, the output power is too high, and is wasted current.

In particular, the conventional LCD panel can provide only about scores of surrounded wiring around the panel and most of the source lines are light load, which makes this problem remarkable.

Additionally, because the conventional LCD driver is designed for the output capacity to meet heavy load, in cases where the difference between light load and heavy load is too big, in the light load source line an over shoot or an under shoot of output wave form is generated, and there may be abnormal voltage for writing to a liquid crystal may happen.

SUMMARY OF THE INVENTION

It is therefore an object of the present invention to provide a liquid crystal display which is capable of decreasing the current consumption and can prevent the abnormal writing to a liquid crystal.

According to a first aspect of the present invention, there is provided a liquid crystal display having a liquid crystal display driver that drives transistors through plural source lines on the substrate in which transistors and pixel electrodes are disposed in matrix, the liquid crystal display driver comprising: a shift register for inputting a clock signal; a data register for receiving the data from the shift register, and inputting display data of red, green and blue and an output power control signal designating amended source lines, the output power control signal accompanied with the display data of red, green and blue; a latch for receiving the data from the data register and inputting a strobe signal; a digital to analog converter for receiving the data from the latch and with the inputting of a strobe signal, converting the inputted digital data to analog data; and an output amplifier comprising plural output circuits which receives the data from the digital to analog converter and outputs to the plural source lines respectively. The output amplifier makes the output power for the amended source lines higher to implement the output.

According to the present invention, by appointing the output amplifier corresponding to the amended source line beforehand, it is it possible to increase only the bias current of the output amplifier corresponding to the heavy load source line, and make only the output power of amended source line higher, and make the reduction of current consumption at the output amplifier which corresponds to non-amended light load source line possible. Furthermore, the possibility of generation of over shoot or under shoot can be decreased.

According to a second aspect of the present invention, there is provided a liquid crystal display in accordance with the first aspect of the present invention, the output amplifier comprising: a power supply supplying voltage to the output amplifier; a first constant current circuit having one terminal grounded and the other terminal connected to a differential input circuit; a differential input circuit inputting a voltage from the power supply, analog data and an output from the first constant current circuit and outputting a differential output to a gate of the first transistor and a switch; a bias current circuit inputting the analog data and outputting a bias current; a second constant current circuit inputting a voltage from the power supply and a bias current outputted from the bias current circuit and outputting a constant current to both a terminal of the first transistor and a terminal of the second transistor; an output terminal connecting a point provided between the second constant current circuit and a terminal of the first transistor and a point provided between the second constant current circuit and a terminal of the second transistor; a first transistor having the other terminal grounded; a second transistor having the other terminal grounded; a switch connected between a gate of the first transistor and a gate of the second transistor in series, inputting a signal indicating whether a source line is amended or not and turning "on" or "off" based on the above signal; and a resistor disposed between the other terminal and the gate of the second transistor.

According to the present invention, a first aspect of the present invention is accomplished, and the switch changes to "on" or "off" based on the signal indicating whether the source line is amended or not. According to this change the switch changes the state of conduction of the second transistor so as to change the output power. Therefore, the output power in each source line is able to be controlled more correctly.

According to a third aspect of the present invention, there is provided a liquid crystal display according to the second aspect of the invention, characterized in that the analog data is analog data outputted from the analog to digital converter.

According to the present invention, the function of the second aspect is obtained, and because the analog data is the data from the analog to digital converter, the output power for the amended source line is able to be made higher more accurately.

According to a fourth aspect of the present invention, there is provided a liquid crystal display according to the second or the third aspect, characterized in that the output terminal connects to the source lines.

According to the present invention, the function mentioned in the second or the third aspect is obtained, and because the output terminal connects to the source lines, output signals from the output amplifier can be outputted to the source lines properly.

The above and further objects and novel features of the invention will more fully appear from the following detailed description when the same is read in connection with the accompanying drawings. It is to be expressly understood, however, that the drawings are for illustration only and are not intended as a definition of the limits of the invention.

DESCRIPTION OF THE PREFERRED EMBODIMENTS

Figure 5:
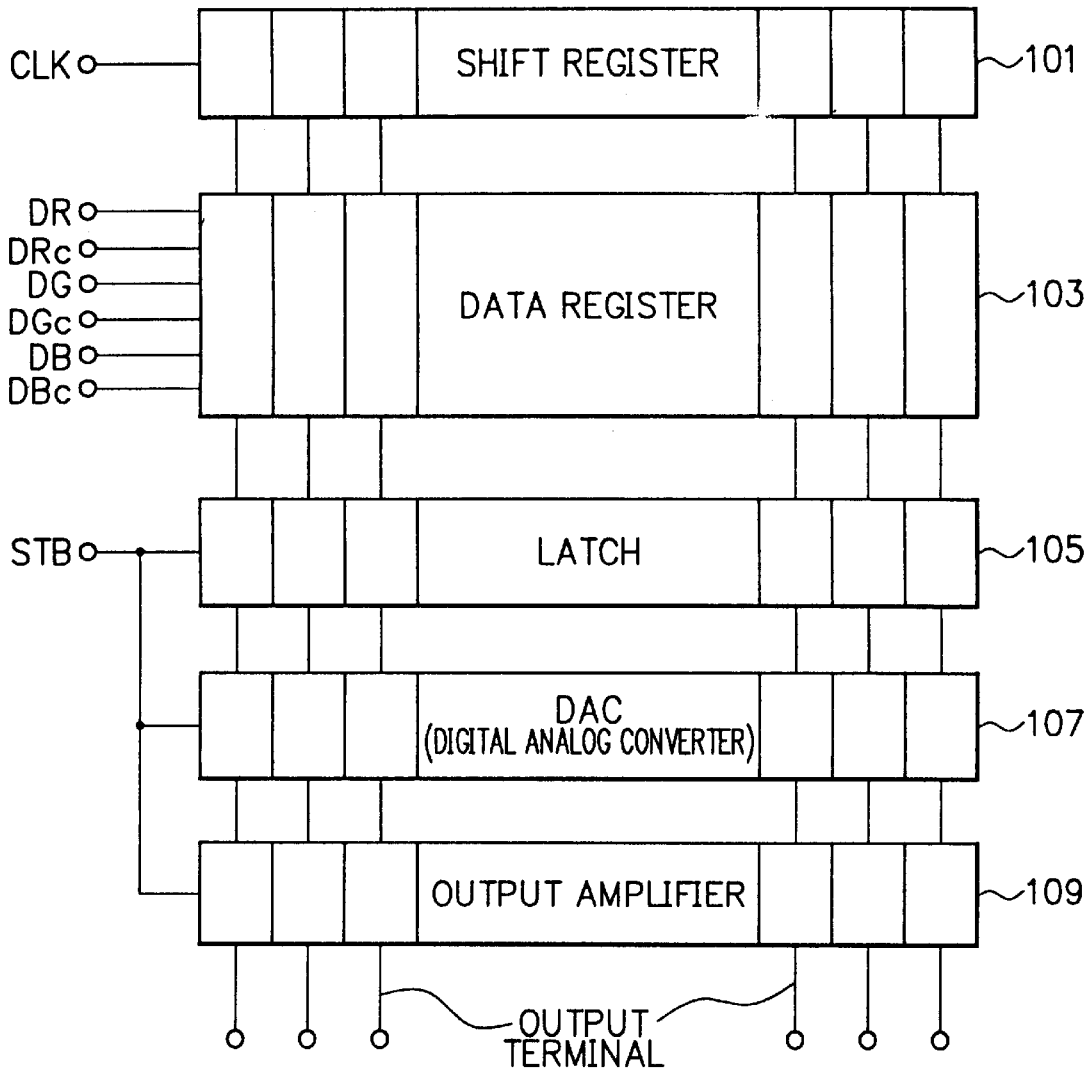
FIG. 5 is a block diagram showing the constitution of an embodiment of an LCD driver provided in the liquid crystal display of the present invention.

A preferred embodiment of the present invention will now be described in detail referring to the accompanying drawings. FIG. 5 shows a block diagram of the constitution of an LCD driver according to the present invention.

As shown in FIG. 5, the LCD driver comprises a shift register 101 in which a CLK signal is inputted, a data register 103 in which red data DR, green data DG and blue data DB as the display data of red, green and blue are inputted and accompanying with DR, DG and DB, the indicating data of the amended source lines DRc, DGc and DBc are inputted, a latch 105 in which a strobe signal STB is inputted, a DAC 107 in which a strobe signal STB is inputted and an output amplifier 109 in which a strobe signal STB is inputted. The output amplifier 109 comprises plural output amplifiers which have output terminals respectively.

The shift register 101 forms a reading timing of display data and outputs the data to the data register 103.

As mentioned above, the data register 103 takes in the display data DR, DG and DB and the data DRc, DGc and DBc as output power control signals and then outputs the data to the latch 105.

The latch 105, based on a strobe signal, latches the read data and outputs them to the DAC 107.

The DAC 107 converts digital display data to analog signal and outputs this converted data to the output amplifier 109.

The output amplifier 109 can control the output power to the output terminal connected to a source line, by a control signal for the output power. Output terminals connect to the output amplifiers constituting the output amplifier respectively.

Figure 6:
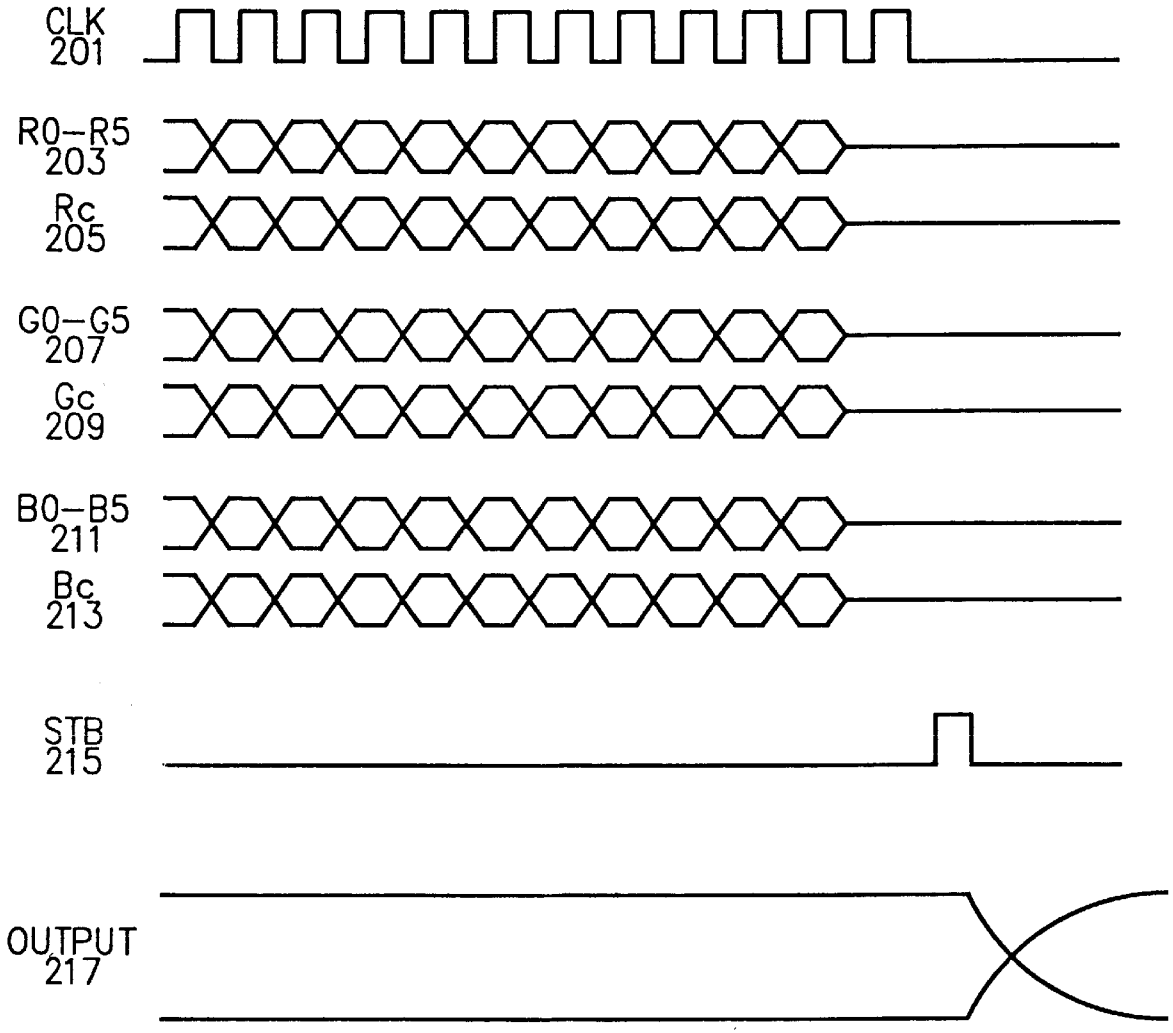
FIG. 6 is a timing chart of each signal in the LCD driver shown in FIG. 5.

Each signal of the LCD driver shown in FIG. 5 is explained referring to FIG. 6. FIG. 6 shows a timing chart of each signal at the LCD driver.

FIG. 6 shows a timing chart of a clock signal CLK201, a red data signal 203, an output power control signal 205 indicating which source line is amended data accompanied with the red data signal 203, a green data signal 207, an output power control signal 209 indicating which source line is amended data accompanied with the green data signal 207, a blue data signal 211, an output power control signal 213 indicating which source line is amended data accompanied with the blue data signal 211, a strobe signal 215, and an analog output 217.

Figure 1:
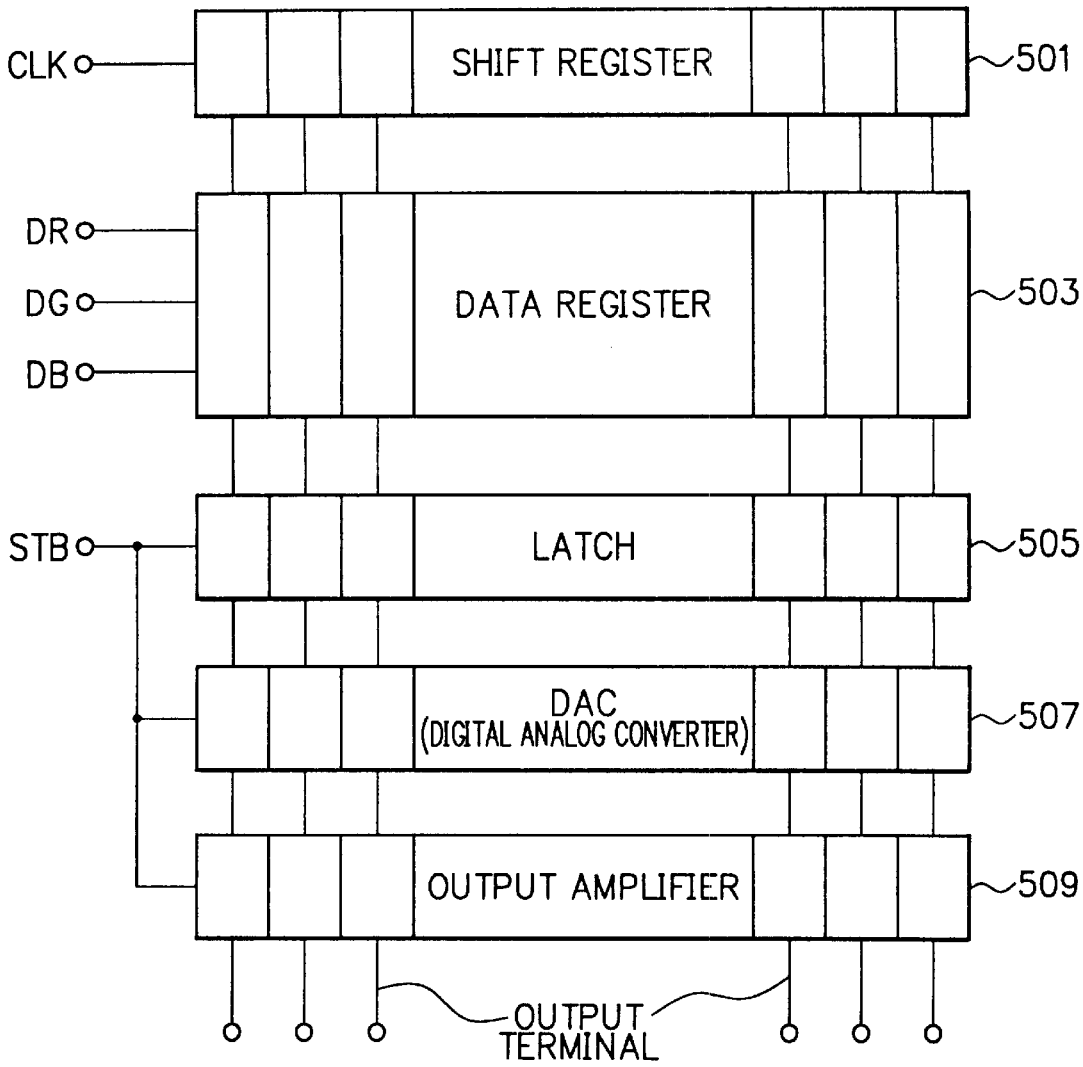
FIG. 1 PRIOR ART
FIG. 1 is a block diagram showing the constitution of an LCD driver of the conventional device.
Figure 2:
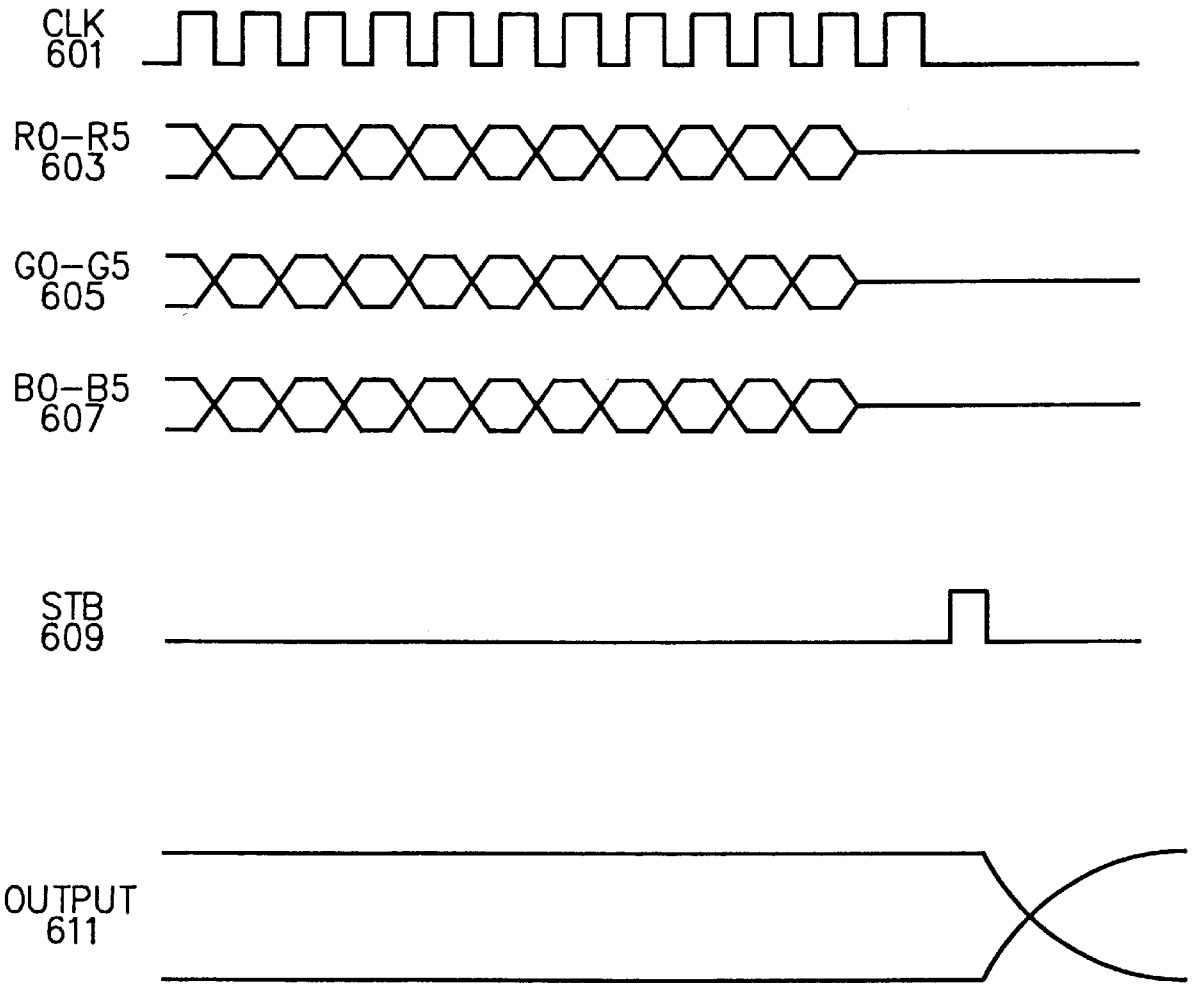
FIG. 2 PRIOR ART
FIG. 2 is a timing chart of each signal in the LCD driver shown in FIG. 1.

The difference between this timing chart and the timing chart in the conventional LCD driver in FIG. 2 is that the present invention reads in the display data 203, 207 and 211 and the output power control signals 205, 209, and 213 which decide whether these source lines are amended (heavy load) or not at the same time, in synchronization with the clock signal CLK 201.

The amended source line does not change in each horizontal period and is decided physically, therefore this information is written in the control circuit of the beginning stage of the LCD driver and the same signal is inputted in each frame.

After reading in all the display data 203, 207 and 211, and the output power control signals 205, 209 and 213 , the analog output 217 is outputted by the strobe signal 215. The output power at this time is decided for each output terminal by the output power control signals 205, 209, and 213.

Figure 7:
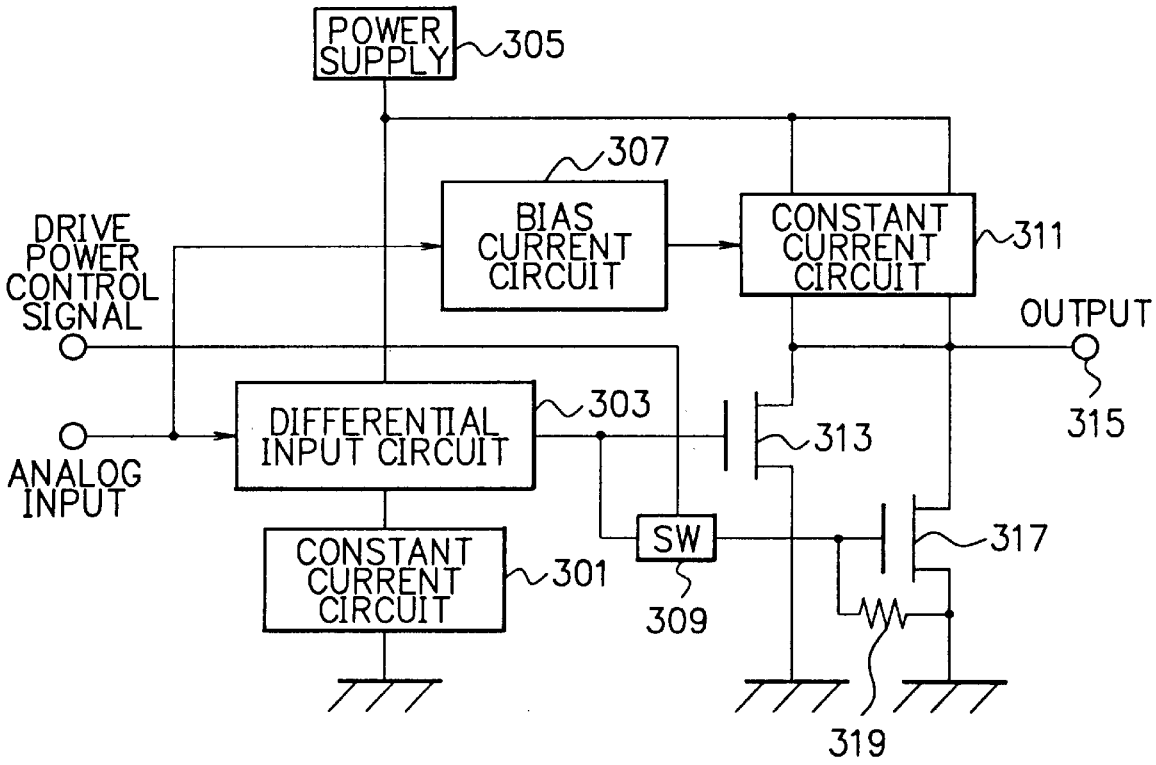
FIG. 7 is a block diagram showing the constitution of an embodiment of an output amplifier in the LCD driver shown in FIG. 5.

An output amplifier 109 shown in FIG. 5 is explained referring to FIG. 7. FIG. 7 shows a block diagram of an embodiment of the output amplifier.

As shown in FIG. 7, this output amplifier comprises a power supply 305 which supplies voltage to this amplifier, a constant current circuit 301 having one terminal grounded and the other connected to a differential input circuit 303, a differential input circuit 303 inputting a voltage from the power supply 305, analog data and an output from the constant current circuit 301, and outputting an output signal to a gate of a transistor 313 and a switch 309, a bias current circuit 307 inputting analog data and outputting a bias current to a constant current circuit 311, a constant current circuit 311 inputting a voltage from a power supply 305 and an output from a bias current circuit 307, and outputting an output signal to a terminal of transistor 313 and a terminal of transistor 317, a transistor 313 whose one terminal is connected to the constant current circuit 311, the other is grounded and a gate is connected to the differential input circuit 303, a transistor 317 whose one terminal is connected to a constant current circuit 311, the other is grounded and whose gate is connected to a switch 309, a switch 309 connected between a gate of the transistor 313 and a gate of the transistor 317 in series, and a resistor 319 connected between a gate of the transistor 317 and the grounded terminal of the transistor 317 in series.

Figure 3:
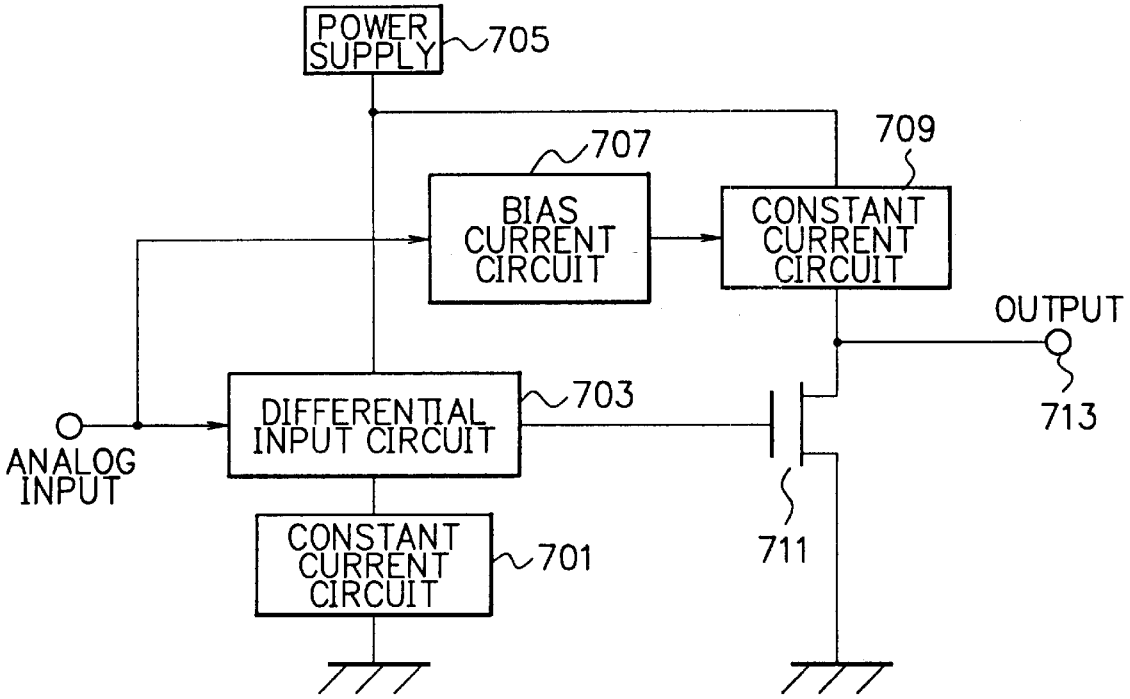
FIG. 3 PRIOR ART
FIG. 3 is a block diagram showing the constitution of an output amplifier provided in the LCD driver shown in FIG. 1.

The difference between the output amplifier shown in FIG. 7 and the conventional output amplifier shown in FIG. 3 is that a driving power control signal decides the operation of the final stage transistor 317 in the present invention.

When a driving source line is not amended, the higher output power is not needed, a switch 309 is in the state of "off" by the driving power control signal and in consequence the drive is implemented by only the transistor 313.

On the contrary, in case of driving the amended source line, a switch 309 is turned to the state of "on" by the driving power control signal and in consequence the drive is implemented by both transistors 313 and 317.

As mentioned above, in the LCD having the LCD driver shown in FIGS. 5 and 7, the amendment is implemented only in the source lines generating the line defect, at the driving of amended source lines, only the output power for the amended source lines is increased in the output amplifier 109 and for the non-amended source lines, power consumption is low and is saved. Additionally the difference between light load and heavy load can be lessened, therefore, in the light load source line, either over shoot or under shoot of the output wave form can be prevented and an abnormal voltage for writing to the LCD can be decreased.

Figure 4:
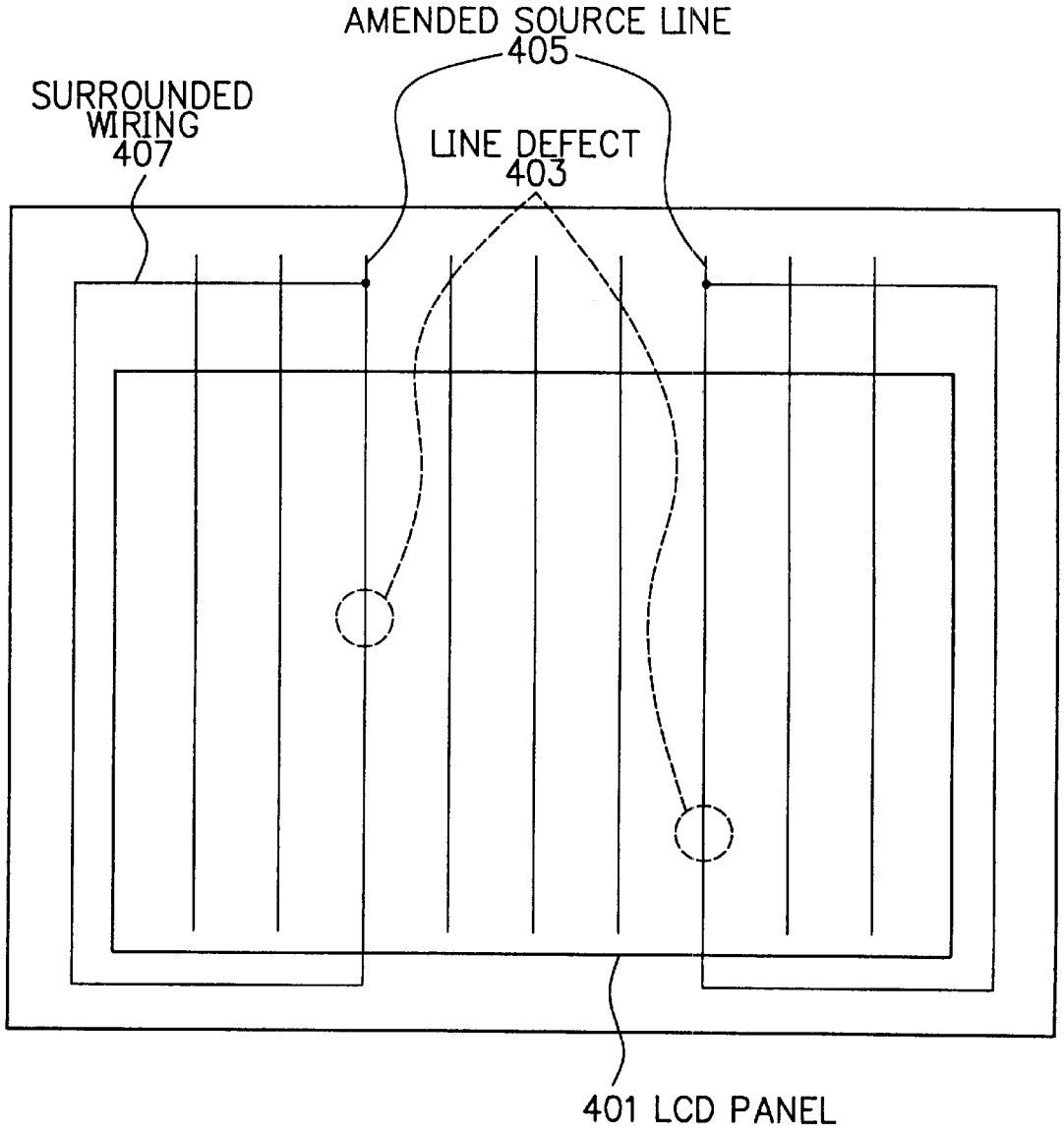
FIG. 4 is a conceptual diagram showing an LCD panel where line defects of source lines are amended in the liquid crystal display of the present invention and of the conventional device.

In the present invention, LCD which happens to have line defects is shown in FIG. 4. However, because the explanation is the same as the conventional device, the explanation is omitted.

As mentioned above, at the LCD panel with amended source lines, since only the output power for amended source lines is increased and the output power for non-amended source lines remains as normal and is not increased, the LCD of the present invention makes it possible to reduce the power consumption.

Furthermore, the output power of the LCD driver can be adjusted for both the amended source lines and non-amended source lines, the present invention can provide an LCD that is capable of normal writing.

While preferred embodiments of the invention have been described using specific terms, such description is for illustrative purpose only, and it is to be understood that changes and variations may be made without departing from the spirit or the scope of the following claims.

What is claimed is:

1. A liquid crystal display having a liquid crystal display driver that drives transistors through plural source lines on a substrate in which transistors and pixel electrodes are disposed in a matrix, said liquid crystal display driver comprising:

a shift register for inputting a clock signal;

a data register for receiving data from said shift register, and inputting display data of red, green and blue and an output power control signal for each red, green and blue signal of said display data, said output power control signal designating amended source lines;

a latch for receiving data from said data register and inputting a strobe signal;

a digital to analog converter which receives data from said latch, inputs said strobe signal, and converts said data from said latch to analog data; and an output amplifier having plural output circuits and receiving said analog data and outputting signals to said plural source lines respectively, wherein in said operational amplifier, said output power control signals alter said output signals to said amended source lines so that said output signals to said amended source lines have power levels that differ from those of said output signals to non-amended source lines.

2. A liquid crystal display having a liquid crystal display driver that drives transistors through plural source lines on a substrate in which transistors and pixel electrodes are disposed in a matrix, said liquid crystal display driver comprising:

a shift register for inputting a clock signal;

a data register for receiving data from said shift resister, and inputting display data of red, green and blue and an output power control signal designating amended source lines, said output power control signal accompanied with said display data of red, green and blue;

a latch for receiving data from said data register and inputting a strobe signal;

a digital to analog converter which receives data from said latch, inputs said strobe signal, and converts said data from said latch to analog data; and an output amplifier said output amplifier comprising:

a power supply supplying voltage to said output amplifier;

a first constant current circuit having a first terminal grounded and a second terminal connected to a differential input circuit;

a differential input circuit for receiving said voltage, said analog data and an output from said first constant current circuit and outputting a differential output to a gate of a first transistor and a switch;

a bias current circuit for receiving said analog data and outputting a bias current;

a second constant current circuit for receiving a voltage from said power supply and said bias current and outputting a constant current to a first terminal of said first transistor and a first terminal of a second transistor;

an output terminal connected between said second constant current circuit and said first terminal of said first transistor and between said second constant current circuit and said first terminal of said second transistor;

a switch connected between a gate of said first transistor and a gate of said second transistor in series, inputting a signal which indicates whether a source line is amended and turning "on" or "off" based on said indicating signal; and a resistor disposed between a second terminal of said second transistor and said gate of said second transistors, wherein a second terminal of said first transistor and said second terminal of said second transistor are grounded, wherein said output amplifier receives said analog data and outputs signals to plural source lines, and wherein said output signals to said amended source lines have a higher power level than that of said output signals to non-amended source lines.

3. A liquid crystal display in accordance with claim 2, wherein said analog data is analog data outputted from said digital to analog converter.

4. A liquid crystal display in accordance with claim 2, wherein said output terminal connects to said source lines.

5. A liquid crystal display in accordance with claim 3, wherein said output terminal connects to said source lines.

6. A liquid crystal display according to claim 2, wherein said switch changes a state of conduction of said second transistor so that said output signals are amplified more when said switch is "on" than when said switch is "off".

7. A liquid crystal display according to claim 2, wherein said liquid crystal display driver simultaneously receives said display data, said output power control signals and said clock signal.

8. A liquid crystal display according to claim 2, wherein said liquid crystal display driver generates a normal voltage for writing to a liquid crystal.

9. A liquid crystal display according to claim 2, wherein said output amplifier further comprises a plurality of output amplifier portions, wherein each said portion has an output terminal which is connected to a source line.

10. A liquid crystal display comprising:

a liquid crystal display driver for generating output signals to drive transistors; and a plurality of source lines for transmitting said output signals, wherein said plurality of source lines comprise amended and non-amended source lines, wherein said output signals to said amended source lines have a higher power level than that of said output signals to said non-amended source lines, wherein said liquid crystal display driver comprises:

a shift register for inputting a clock signal;

a data register for inputting data from said shift register, display data and output power control signals;

a latch for receiving data from said data register;

a digital to analog converter which receives data from said latch and converts said data from said latch to analog data; and an output amplifier portion having plurality of output terminals connected to source lines and receiving said analog data and outputting signals to said source lines, wherein said output amplifier portion comprises a plurality of output amplifiers, each said output amplifier comprising:

a first constant current circuit having a first terminal grounded and a second terminal connected to a differential input circuit;

a differential input circuit for receiving analog data and an output from said first constant current circuit and outputting a differential output to a gate of a first transistor and a switch;

a bias current circuit for receiving said analog data and outputting a bias current;

a second constant current circuit for receiving said bias current and outputting a constant current to a first terminal of said first transistor and a first terminal of a second transistor;

an output terminal connected between said second constant current circuit and said first terminal of said first transistor and between said second constant current circuit and said first terminal of said second transistor and connected to said plural source lines;

a switch connected between a gate of said first transistor and a gate of said second transistor in series, inputting a power control signal and switching "on" or "off" based on said indicating signal; and a resistor disposed between a second terminal of said second transistor and said gate of said second transistor, wherein a second terminal of said first transistor and said second terminal of said second transistor are grounded, wherein said output amplifier receives said analog data and outputs a signal to a source line, and wherein said output signal to an amended source line is higher than said output signal to a non-amended source line.

11. A liquid crystal display in accordance with claim 10, wherein said switch changes a state of conduction of said second transistor so that output signals when said switch is "on" are higher than said output signals when said switch is "off".

12. A liquid crystal display in accordance with claim 10, wherein said liquid crystal display driver simultaneously inputs said display data, said output power control signals and said clock signal.

13. A liquid crystal display in accordance with claim 10, wherein said liquid crystal display driver generates a normal voltage for writing to a liquid crystal.

14. An output amplifier for a liquid crystal display, comprising:

a first constant current circuit having a terminal grounded and a second terminal connected to a differential input circuit;

a differential input circuit for receiving analog data and an output from said first constant current circuit and outputting a differential output to a gate of a first transistor and a switch;

a bias current circuit for receiving said analog data and outputting a bias current;

a second constant current circuit for receiving said bias current and outputting a constant current to a first terminal of said first transistor and a first terminal of a second transistor; and an output terminal connected between said second constant current circuit and said first terminal of said first transistor and between said second constant current circuit and said first terminal of said second transistor and connected to said plural source lines.

15. The output amplifier according to claim 14, wherein said first transistor has a second terminal grounded.

16. The output amplifier according to claim 14, wherein said second transistor has a second terminal grounded.

17. The output amplifier according to claim 14, further comprising:

a switch connected between a gate of said first transistor and a gate of said second transistor in series, inputting a power control signal and switching "on" or "off" based on power control signal.

18. The output amplifier according to claim 17, further comprising:

a resistor disposed between a second terminal of said second transistor and said gate of said second transistor.

* * * * *